US010519575B2

(12) United States Patent
Thompson et al.

(10) Patent No.: US 10,519,575 B2
(45) Date of Patent: Dec. 31, 2019

(54) CONDUCTIVE FABRIC, METHOD OF MANUFACTURING A CONDUCTIVE FABRIC AND APPARATUS THEREFOR

(71) Applicant: Intelligent Textiles Limited, Middlesex (GB)

(72) Inventors: Asha Peta Thompson, Middlesex (GB); Stanley Shigezo Swallow, London (GB)

(73) Assignee: Intelligent Textiles Limited (GB)

( * ) Notice: Subject to any disclaimer, the term of this patent is extended or adjusted under 35 U.S.C. 154(b) by 208 days.

(21) Appl. No.: 15/378,820

(22) Filed: Dec. 14, 2016

(65) Prior Publication Data

US 2017/0175305 A1 Jun. 22, 2017

(30) Foreign Application Priority Data

Dec. 18, 2015 (EP) ..... 15275267
Dec. 18, 2015 (GB) ..... 1522351.4

(51) Int. Cl.
*D03D 1/00* (2006.01)
*D03D 15/00* (2006.01)
(Continued)

(52) U.S. Cl.
CPC ..... *D03D 1/0088* (2013.01); *A41D 1/002* (2013.01); *A41D 1/04* (2013.01); *A41D 1/06* (2013.01);
(Continued)

(58) Field of Classification Search
CPC ..... D03D 1/0088; D03D 13/00; D03D 15/00; D10B 2101/20; D10B 2401/16;
(Continued)

(56) References Cited

U.S. PATENT DOCUMENTS 3,378,629 A 4/1968 Stanley
3,414,666 A 12/1968 Doundoulakis et al.
(Continued)

FOREIGN PATENT DOCUMENTS

CN 101 413 168 A 4/2009
CN 101413168 A 4/2009
(Continued)

OTHER PUBLICATIONS

International Search Report and Written Opinion, PCT/GB2016/053693, dated Apr. 10, 2017.
(Continued)

*Primary Examiner* — Jennifer A Steele
(74) *Attorney, Agent, or Firm* — Craig A. Fieschko, Esq.; DeWitt LLP

(57) ABSTRACT

A woven fabric formed of a first set of yarns extending in a first direction, woven together with a second set of yarns extending in a second direction. The first set includes first conductors, while the second set includes second conductors. The first and second conductors cross over one another at crossing points. At each crossing point, a non-conductive element is disposed directly between the first and second conductors so as to provide a physical barrier between the first and second conductors. At some crossing points, a physical electrical connection is provided between crossing conductors in order to provide a permanent connection between the conductors. Non-conductive tie yarns are provided to fix the conductors in position. The structure provides a robust yarn with minimized risk of short circuiting between crossing conductors which are intended to be kept separate.

31 Claims, 6 Drawing Sheets

(51) Int. Cl.

| | |
|---|---|
| ***D03D 13/00*** | (2006.01) |
| ***A41D 1/04*** | (2006.01) |
| ***A41D 1/06*** | (2006.01) |
| ***A41D 1/00*** | (2018.01) |
| ***A41D 19/00*** | (2006.01) |
| ***A42B 3/04*** | (2006.01) |
| ***A41D 3/08*** | (2006.01) |

(52) U.S. Cl.
CPC ..... *A41D 3/08* (2013.01); *A41D 19/00* (2013.01); *A42B 3/04* (2013.01); *D03D 13/00* (2013.01); *D03D 15/00* (2013.01); *A41D 2500/20* (2013.01); *D10B 2101/20* (2013.01); *D10B 2401/16* (2013.01); *D10B 2501/04* (2013.01)

(58) Field of Classification Search
CPC ... A41D 3/08; A41D 1/04; A41D 1/06; A41D 19/00; A41D 1/002; A41D 2500/20; A42B 3/04; H05K 1/0393; H05K 1/038; H05K 2201/05; A61B 5/6804; H05B 3/342
See application file for complete search history.

(56) References Cited

U.S. PATENT DOCUMENTS

| | | | | |
|---|---|---|---|---|
| 3,513,297 | A | 5/1970 | Jordan | |
| 3,711,627 | A | 1/1973 | Maringulov | |
| 3,798,370 | A | 3/1974 | Hurst | |
| 3,911,215 | A | 10/1975 | Hurst et al. | |
| 4,080,519 | A | 3/1978 | Michalson | |
| 4,085,302 | A | 4/1978 | Zenk et al. | |
| 4,220,815 | A | 9/1980 | Gibson et al. | |
| 4,484,038 | A | 11/1984 | Dorman et al. | |
| 4,538,054 | A | 8/1985 | De La Bretoniere et al. | |
| 4,659,873 | A | 4/1987 | Gibson et al. | |
| 4,687,885 | A | 8/1987 | Talmage, Jr. et al. | |
| 4,707,845 | A | 11/1987 | Krein et al. | |
| 4,715,235 | A | 12/1987 | Fukui et al. | |
| 4,776,160 | A | 10/1988 | Rees | |
| 4,795,998 | A | 1/1989 | Dunbar et al. | |
| 4,798,919 | A | 1/1989 | Miessler et al. | |
| 4,822,957 | A | 4/1989 | Talmage, Jr. et al. | |
| 4,933,660 | A | 6/1990 | Wynne, Jr. | |
| 5,047,602 | A | 9/1991 | Lipka | |
| 5,060,527 | A | 10/1991 | Burgess | |
| 5,159,159 | A | 10/1992 | Asher | |
| 5,220,136 | A | 6/1993 | Kent | |
| 5,262,778 | A | 11/1993 | Saunders | |
| 5,422,462 | A | 6/1995 | Kishimoto | |
| 5,441,798 | A * | 8/1995 | Nishimura | B01D 39/083 442/205 |
| 5,453,941 | A | 9/1995 | Yoshikawa | |
| 5,686,705 | A | 11/1997 | Conroy et al. | |
| 5,815,139 | A | 9/1998 | Yoshikawa et al. | |
| 5,852,260 | A | 12/1998 | Yoshikawa | |
| 5,878,620 | A | 3/1999 | Gilbert et al. | |
| 5,881,547 | A | 3/1999 | Chiou et al. | |
| 6,032,450 | A | 3/2000 | Blum | |
| 6,210,771 | B1 | 4/2001 | Post et al. | |
| 6,216,545 | B1 | 4/2001 | Taylor | |
| 6,216,546 | B1 | 4/2001 | Bahr | |
| 6,319,015 | B1 | 11/2001 | Faunce | |
| 6,325,110 | B1 * | 12/2001 | Scari | D03D 1/0082 139/426 TW |
| 6,333,736 | B1 | 12/2001 | Sandbach | |
| 6,488,564 | B1 | 12/2002 | Gray | |
| 6,852,395 | B2 | 2/2005 | Dhawan et al. | |
| 7,144,830 | B2 | 12/2006 | Hill | |
| 8,669,195 | B2 | 3/2014 | Swallow et al. | |
| 8,823,395 | B2 | 9/2014 | Bhattacharya | |
| 2001/0006173 | A1 | 7/2001 | Rock et al. | |
| 2003/0211797 | A1 | 11/2003 | Hill et al. | |
| 2008/0196783 | A1 * | 8/2008 | Van Bruggen | D03D 1/0088 139/319 |
| 2008/0233822 | A1 * | 9/2008 | Swallow | D03D 1/0088 442/185 |
| 2010/0208445 | A1 | 8/2010 | Asvadi et al. | |
| 2010/0279572 | A1 * | 11/2010 | Fujita | C09K 3/16 442/195 |
| 2012/0279512 | A1 | 11/2012 | Hon | |
| 2014/0246415 | A1 * | 9/2014 | Wittkowski | B60N 2/5685 219/201 |

FOREIGN PATENT DOCUMENTS

| | | | |
|---|---|---|---|
| DE | 42 36 187 | A1 | 5/1993 |
| EP | 0 161 895 | A2 | 12/1985 |
| EP | 0 172 783 | A2 | 2/1986 |
| EP | 0 210 063 | A2 | 6/1986 |
| EP | 0 194 861 | A2 | 9/1986 |
| EP | 0 206 450 | A2 | 12/1986 |
| EP | 0 222 239 | B1 | 5/1987 |
| EP | 0 392 736 | A2 | 4/1990 |
| EP | 0 454 269 | A2 | 4/1991 |
| EP | 0 855 307 | A2 | 7/1998 |
| EP | 0 911 435 | A2 | 4/1999 |
| EP | 0 989 509 | A2 | 3/2000 |
| EP | 1 339 259 | A | 8/2003 |
| GB | 1 331 942 | | 9/1973 |
| GB | 1 516 004 | | 6/1978 |
| GB | 2 095 036 | A | 9/1982 |
| GB | 2 115 555 | A | 9/1983 |
| GB | 2 134 719 | A | 8/1984 |
| GB | 2 222 485 | A | 3/1990 |
| GB | 2 339 495 | A | 5/1998 |
| GB | 2 341 929 | A | 9/1998 |
| GB | 2 339 495 | A | 1/2000 |
| GB | 2 341 933 | A | 3/2000 |
| GB | 2 341 978 | A | 3/2000 |
| GB | 2 343 516 | A | 5/2000 |
| JP | 5 801 7331 | | 2/1983 |
| RU | 2 046 552 | C1 | 10/1995 |
| RU | 2 145 984 | C1 | 2/2000 |
| RU | 2 155 461 | C1 | 8/2000 |
| RU | 2 187 907 | C1 | 8/2002 |
| WO | WO 86 05678 | A1 | 3/1986 |
| WO | WO 90 10204 | A1 | 9/1990 |
| WO | WO 99 01601 | A1 | 1/1999 |
| WO | WO 99 03600 | A1 | 1/1999 |
| WO | WO 99 26627 | A1 | 6/1999 |
| WO | WO 99 60357 | A1 | 11/1999 |
| WO | WO 00 26627 | A1 | 5/2000 |
| WO | WO 00 60357 | A1 | 10/2000 |
| WO | WO 01/75778 | A1 | 10/2001 |
| WO | WO 03/095729 | A1 | 11/2003 |
| WO | WO 05/083164 | A2 | 9/2005 |
| WO | WO 06/129272 | A2 | 12/2006 |
| WO | WO 09/050629 | A1 | 4/2009 |
| WO | WO 10/032173 | A1 | 3/2010 |
| WO | WO 13/032173 | A2 | 3/2013 |
| WO | WO 15/101759 | A1 | 7/2015 |

OTHER PUBLICATIONS

Lind et al. (1997). A Sensate liner for personnel monitoring applications. Proc. 1st IEEE Int. Symp. on Wearable Computers (ISWC'97). Oct. 1997. Cambridge, Mass., USA: IEEE Press.

Orth et al., (1998). Fabric computing interfaces. Proc. ACM CHI '98. Apr. 1998. Los Angeles, CA., USA: ACM Press.

Post et al., (1997). Smart fabric, or washable computing. Proc. 1st IEEE Int. Symp. on Wearable Computers (ISWC'97). Oct. 1997. Cambridge, Mass., USA: IEEE Press.

* cited by examiner

CONDUCTIVE FABRIC, METHOD OF MANUFACTURING A CONDUCTIVE FABRIC AND APPARATUS THEREFOR

FIELD OF THE INVENTION

The present invention relates to a conductive fabric, to a method of manufacture of such a fabric and to weaving apparatus arranged to weave such a fabric. In particular, the teachings herein can provide a fabric incorporating a plurality of conductive yarns into a woven fabric sheet, with the conductive yarns being present in both the warp and weft directions of the fabric. The teachings herein can also be used to weave electronic circuits and circuit components into the fabric.

BACKGROUND ART

There have been many attempts over recent years to manufacture fabrics having conductive elements therein, useful for a variety of applications including communication, powering peripheral devices, data transfer or collection, sensing and the like. Early devices sought to form multi-layered structures, intended to create physical separation between the plurality of conductors in the structure. These devices, however, were bulky, unreliable and prone to delamination.

In the applicant's earlier EP-1,269,406 and EP-1,723,276 fabric weave structures are disclosed which have proven to provide a reliable conductive fabric structure with intercrossing conductive yarns which may be kept separate from one another, arranged to touch one another under pressure or permanently connected together. There are also described electronic components formed by the conductive yarns. The structures disclosed in these applications have been found to work very reliably and to have good longevity. There is now a need for a fabric having larger conductors, for example for delivering more power through the fabric, and for use in harsh and demanding conditions.

Other examples of conductive fabrics can be found in U.S. Pat. Nos. 3,711,627 and 3,414,666. The disclosures in these documents disclose impregnating the fabric with plastic substances such as polyester resins or an elastic insulating compound for reliability and preventing short circuits. However, coating or impregnating a textile is undesirable for a number of reasons. It adds expense and additional complication to the manufacturing process, as well as rendering the textile heavier, thicker and stiffer. These latter effects compromise some of the very qualities that may be sought and desirable from the outset in a conductive textile.

It is important to minimize the risk of undesired short circuiting of the conductors in the fabric. This risk increases when the textile is worn upon the body, where it can be subjected to bending, creasing and the incidence of pressure. The risk is also greater when the diameter of the conductive yarns is larger, which limits the diameter of conductive yarns which may reliably be employed, in turn limiting the linear conductivities of the yarns. This results in increased resistances within the textile circuits created, which decreases electrical efficiency and ultimately limits the operating current and power of the circuits.

SUMMARY OF THE INVENTION

The present invention seeks to provide an improved conductive fabric, a method of manufacture of such a fabric and weaving apparatus arranged to weave such a fabric. In particular, the preferred embodiments described herein can provide a fabric incorporating a plurality of conductive yarns into a woven fabric sheet, with the conductive yarns being present in both the warp and weft directions of the fabric. The teachings herein can also be used to weave electronic circuits and circuit components into the fabric.

According to an aspect of the present invention, there is provided a woven fabric formed of a first set of yarns extending in a first direction and a second set of yarns extending in a second direction, the first and second sets of yarns being woven together, the first set of yarns including at least one first electrical conductor and the second set of yarns including at least one second electrical conductor, the first and second electrical conductors crossing over one another at a crossing point, wherein a non-conductive element in the form of at least one non-conductive yarn of the first set of yarns is interposed directly between the first and second electrical conductors at the crossing point to provide a physical barrier between the first and second electrical conductors; wherein the non-conductive element is formed of at least two non-conductive yarns of the first set of yarns, and wherein the at least two non-conductive yarns extend on opposing sides of the first conductor and are laterally arranged over the first conductor at the crossing point so as to be interposed between the first and second conductors at the crossing point.

The fabric incorporates a physical barrier formed from at least one non-conductive yarn of the fabric, which in practice prevents the crossing conductors from coming into contact with one another and creating a short circuit. The structure is much more stable and robust than prior art systems, without compromising on the characteristics of the fabric. It is not necessary to have insulating coatings or to rely on a simple spacing between the crossing conductors.

In practice, the at least two non-conductive yarns extending on opposing sides of the first conductor are laterally biased so as to be deflected over the first conductor at the crossing point.

The arrangement creates a very reliable and robust separation between the crossing conductors and can create an optimum structure resilient to significant bending and folding of the fabric. In some embodiments the at least two non-conductive yarns may be obtained from a common side relative to the first conductor.

In the preferred embodiment, the second set of yarns includes at least one non-conductive floating yarn extending over the non-conductive element at the crossing point. This non-conductive floating yarn or yarns is advantageously disposed below the second conductor at the crossing point, such that the first and second conductors are disposed on opposing sides of the non-conductive element and the non-conductive floating yarn or yarns at the crossing point. This non-conductive floating yarn or yarns of the second set can act to compact the yarn or yarns of the non-conductive element together and over the first conductor, creating a stable arrangement of yarns.

In a practical embodiment, there may be provided first and second spacer non-conductive yarns in the second set of yarns, the first and second spacer yarns being disposed between the non-conductive yarn of the second set and the second conductor. The spacer yarns in effect separate the second conductor from the compacting yarn and create a double compaction function, of the compacting yarn and then of the second conductor.

Advantageously, the first set of yarns includes first and second tie yarns extending over the second conductor to hold the second conductor in position. In practice, the tie yarns preferably extend across the second conductor in between adjacent parallel first conductors within the weave.

Preferably, the first and second conductors are conductive yarns. These may be a composite structure for example having a nylon, polyester or aramid core coated in or braided over by a conductive material such as silver, gold, copper, brass, stainless steel or carbon.

In the preferred embodiment, the non-conductive element has a greater number of strands than a number of strands of the first conductor. In practice, a greater number of strands can create a significant barrier between the crossing conductors and can enable the non-conductive element to have a greater lateral width in the weave, which improves robustness and reliability of the fabric. For these and similar purposes, the non-conductive element may have a greater width than a width of the first conductor and/or may be laterally expandable relative to the first conductor.

In a practical implementation, the woven fabric includes a plurality of first and second conductors and a plurality of crossing points therebetween, at least one of the crossing points having non-conductive elements separating the crossing first and second conductors. At one or more of the crossing points at least one pair of first and second conductors may touch one another to make an electrical connection therebetween.

In an embodiment, the first set of non-conductive yarns and the or each first conductor extend along the warp of the fabric and the second set of non-conductive yarns and the or each second conductor extend along the weft of the fabric. In another embodiment, the first set of non-conductive yarns and the or each first conductor extend along the weft of the fabric and the second set of non-conductive yarns and the or each second conductor extend along the warp of the fabric.

According to another aspect of the present invention, there is provided a method of making a conductive woven fabric, including the steps of:

providing for one of the warp and the weft a first set of yarns including at least one first electrical conductor;

providing for the other of the warp and the weft a second set of yarns including at least one second electrical conductor;

weaving the first and second sets of yarns and conductors, wherein the first and second electrical conductors cross over one another at a crossing point; and weaving a non-conductive element formed of at least one non-conductive yarn of the first set of yarns so as to be interposed directly between the first and second electrical conductors at the crossing point to provide a physical barrier between the first and second electrical conductors.

Preferably, the non-conductive element includes at least two non-conductive yarns of the first set of yarns and the method includes the step of pressing the at least two non-conductive yarns laterally together between the first and second conductors.

Advantageously, the method includes the steps of disposing the at least two non-conductive yarns on opposing sides of the first conductor and pressing the at least two non-conductive yarns together over the first conductor at the crossing point so as to be interposed between the first and second conductors at the crossing point.

In an embodiment, the second set of yarns includes a non-conductive yarn and the method includes weaving the non-conductive yarn over the non-conductive yarn or yarns of the first set at the crossing point. The method may include the step of disposing the non-conductive yarn of the second set below the second conductor at the crossing point, such that the first and second conductors are disposed on opposing sides of the non-conductive yarn or yarns of the first set and the non-conductive yarn of the second set at the crossing point. It may also include the steps of providing first and second spacer non-conductive yarns in the second set of yarns, and disposing the first and second spacer yarns between the non-conductive yarn of the second set and the second conductor.

The method advantageously includes the step of providing in the first set of yarns first and second tie yarns and weaving the tie yarns so as to extend over the second conductor to hold the second conductor in position.

Preferably, the first and second conductors are conductive yarns. The non-conductive yarn or yarns of the non-conductive element may have a greater number of strands than a number of strands of the first conductor. The non-conductive element has a greater width than a width of the first conductor. The non-conductive element is preferably laterally expandable relative to the first conductor.

Advantageously, the method includes the steps of providing a plurality of first and second conductors and weaving the pluralities of first and second conductors so as to have a plurality of crossing points therebetween, at least one of the crossing points having non-conductive elements separating the crossing first and second conductors. It may also include weaving the yarns such that at one or more of the crossing points at least one pair of first and second conductors touch one another to make an electrical connection therebetween.

In a preferred embodiment, the first and/or second electrical conductors are subject to warp and/or weft floats over or under more than one yarn in order to allow the insertion of the non-conductive elements.

According to another aspect of the present invention, there is provided a system for weaving a conductive fabric according to the method disclosed herein.

The system preferably includes a controller which is operable to vary a timing of weft insertion, to vary shed geometry.

Preferably, the non-conductive element includes at least two non-conductive yarns of the first set of yarns and the system is arranged to press the at least two non-conductive yarns laterally together between the first and second conductors. Advantageously, the at least two non-conductive yarns are disposed on opposing sides of the first conductor and the system is arranged to press the at least two non-conductive yarns together over the first conductor at the crossing point so as to be interposed between the first and second conductors at the crossing point.

In a preferred embodiment, the second set of yarns includes a non-conductive yarn and the system is arranged to weave the non-conductive yarn over the non-conductive yarn or yarns of the first set at the crossing point.

The system is advantageously arranged to dispose the non-conductive yarn of the second set below the second conductor at the crossing point, such that the first and second conductors are disposed on opposing sides of the non-conductive yarn or yarns of the first set and the non-conductive yarn of the second set at the crossing point.

In the preferred embodiment, the system is set up to alter the rate of progress of the warp yarns between a first relatively fast rate and a second relatively slow rate, wherein weft yarns are bunched together during the relatively slow rate, wherein crossing points of the fabric are formed during the relatively slow rate. The second rate is usefully at or substantially at zero speed.

Advantageously, the system includes a controller for controlling weaving elements of the system, the controller being designed to increase pick-density locally to a crossover point relative to pick density beyond a crossover point.

Preferably, the controller is operable to control the drive of a positive-drive weaving loom, by momentarily halting or slowing the loom take-up of a direct-(geared-)drive weaving loom and/or performing multiple beat operations with a reed of the loom for each weft insertion.

The preferred embodiments can provide a weave structure that is an improvement over the weave structures of the prior art, in that it interposes non-conductive yarns between the warp and weft conductive yarns at a crossover location. This is done during the weaving operation. The elongated, flexible electrical conductors are advantageously formed of conductive yarns or fibres that are capable of being conveniently manipulated by modifying the set-up of conventional machinery and processes of textile weaving. The elongated, flexible electrical conductors may thus be referred to herein as "conductive yarns", but the use of this term is not intended to limit the scope of what materials or compositions of components might constitute an elongated, flexible electrical conductor.

The interposed non-conductive yarns form a physical barrier to the conductive yarns coming into electrical contact, and in doing so obviate the need for coating or impregnating the fabric to ensure that short-circuits do not occur.

According to another aspect of the present invention, there is provided an item of apparel incorporating a fabric as specified herein, a fabric made by a method as specified herein or a fabric made by a system as specified herein. The item of apparel may be a jacket, coat, vest, trousers or a cape. In other embodiments, the item of apparel may be a helmet or gloves.

Other features and advantages of the teaching herein will become apparent from the specific description which follows.

BRIEF DESCRIPTION OF THE DRAWINGS

Embodiments of the present invention are described below, by way of example only, with reference to the accompanying drawings, in which.

DESCRIPTION OF THE PREFERRED EMBODIMENTS

The preferred embodiments described below relate to a conductive fabric which includes a plurality of electrical conductors, preferably conductive yarns, which can be used for electrical and electronic circuits, for example for delivering power, transferring data, for sensing, for heating, for the construction of electrical circuits or circuit components and so on. The fabric can be formed into a variety of articles including, as examples only, a wearable item of clothing such as a vest or jacket to which can be attached a variety of electrical and electronic devices. These could include, for instance, a camera, a light, a radio or telephone, a battery supply and also a control unit for controlling peripheral components attached to the article. The conductive elements woven into the fabric can be arranged to deliver power, data and so on between the peripheral components and the control unit, as required. The fabric is of a nature that it can be bent, folded, compressed while reliably retaining the arrangement of conductors and ensuring that any crossing conductors do not undesirably come into contact with one another to cause short circuiting.

As is described below, the woven fabric is also able to create permanent electrical connections between crossing conductors within the woven fabric and can also include one or more circuit components as described, for example, in the applicant's earlier patents EP-1,269,406 and EP-1,723,276.

The term "yarn" used herein is intended to have its conventional meaning in the art and may be of a single filament but more typically of a plurality of filaments or strands. The yarns are typically formed in sets or bundles, for example of five to seven yarns per bundle, although the number of yarns per bundle can vary as desired.

The conductors of the preferred embodiments are preferably also of multi-filamentary form, which improves flexibility and durability of the woven fabric. In one preferred embodiment, each conductor includes a support core, which may be made of a conductive or non-conductive material, polyester being a suitable material, although other materials such as nylon, PTFE and aramid may be used. A plurality of conductive wires, such as of copper, brass, silver, gold, stainless steel, carbon or the like, are wound helically around and along the core. The core provides structural strength to the conductive threads. In another preferred embodiment, each conductor is composed of a plurality of filaments, which may be made of nylon, polyester or the like, which are coated, plated or infused with a layer of conductive material such as silver, gold, tin or carbon. The nature of the conductors used in the woven fabric is not essential to the teachings herein and other structures could be used for the conductors.

Figure 1:
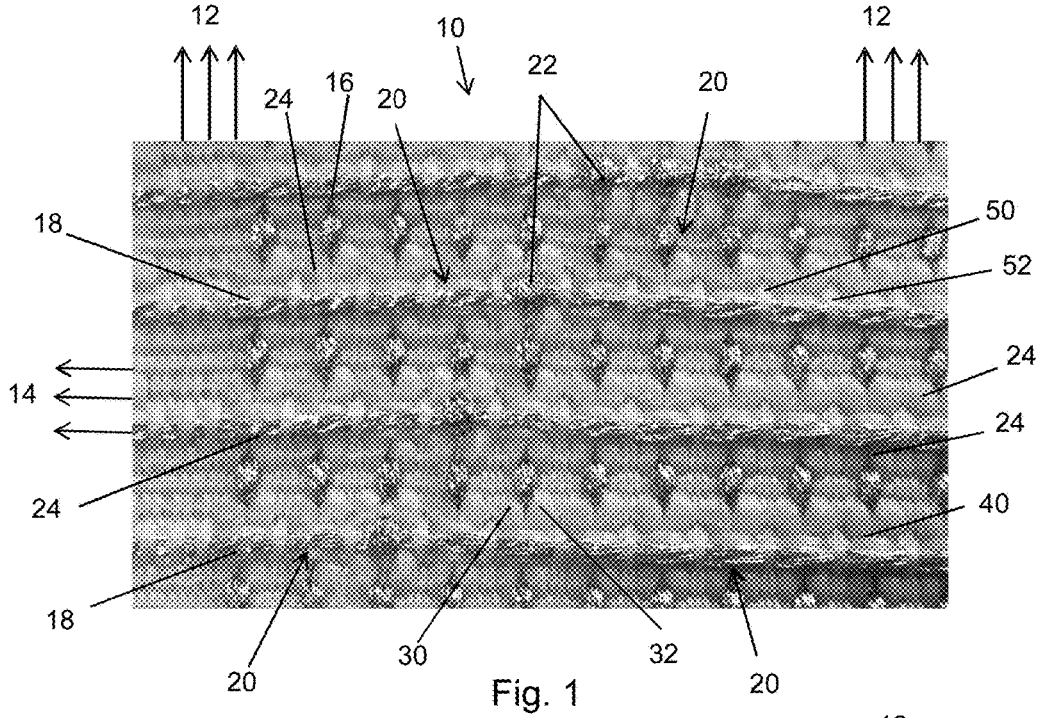
FIG. 1 is a photograph in plan view of a first side of a preferred embodiment of woven conductive fabric according to the teachings herein.
Figure 2:
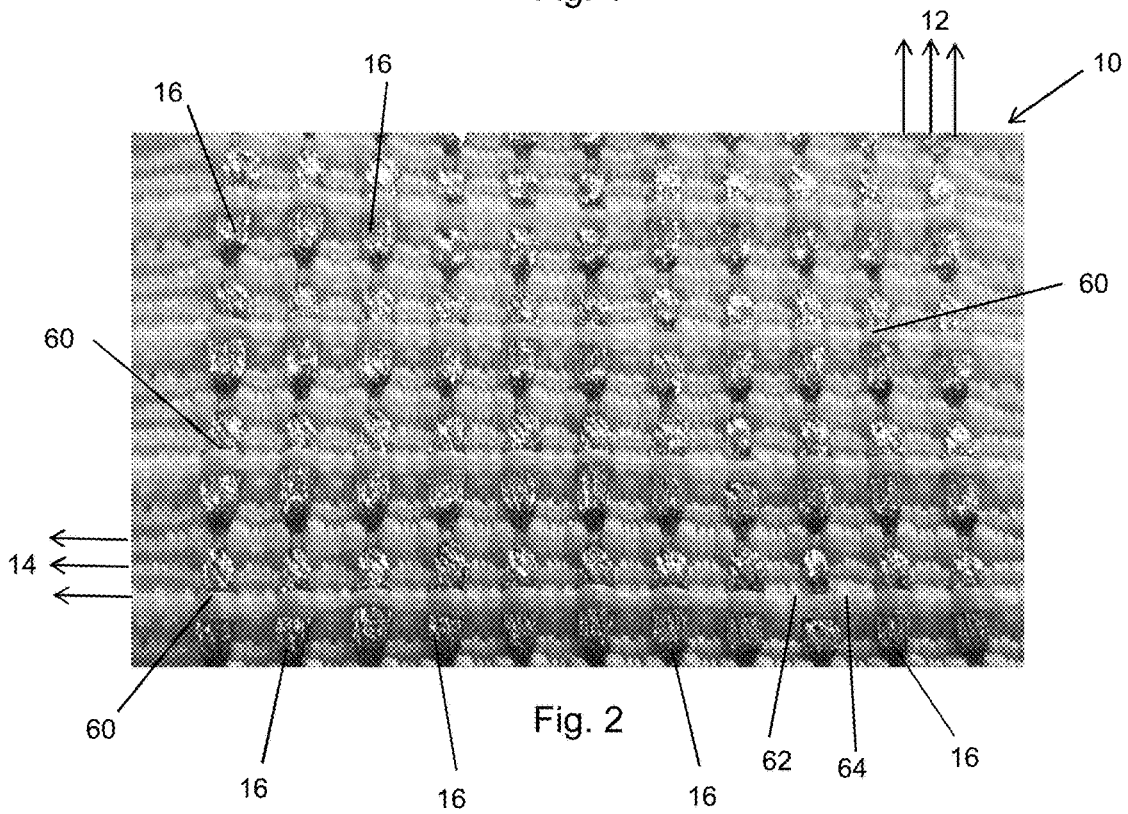
FIG. 2 is a photograph in plan view of the opposite side of the fabric of FIG. 1.
Figure 3:
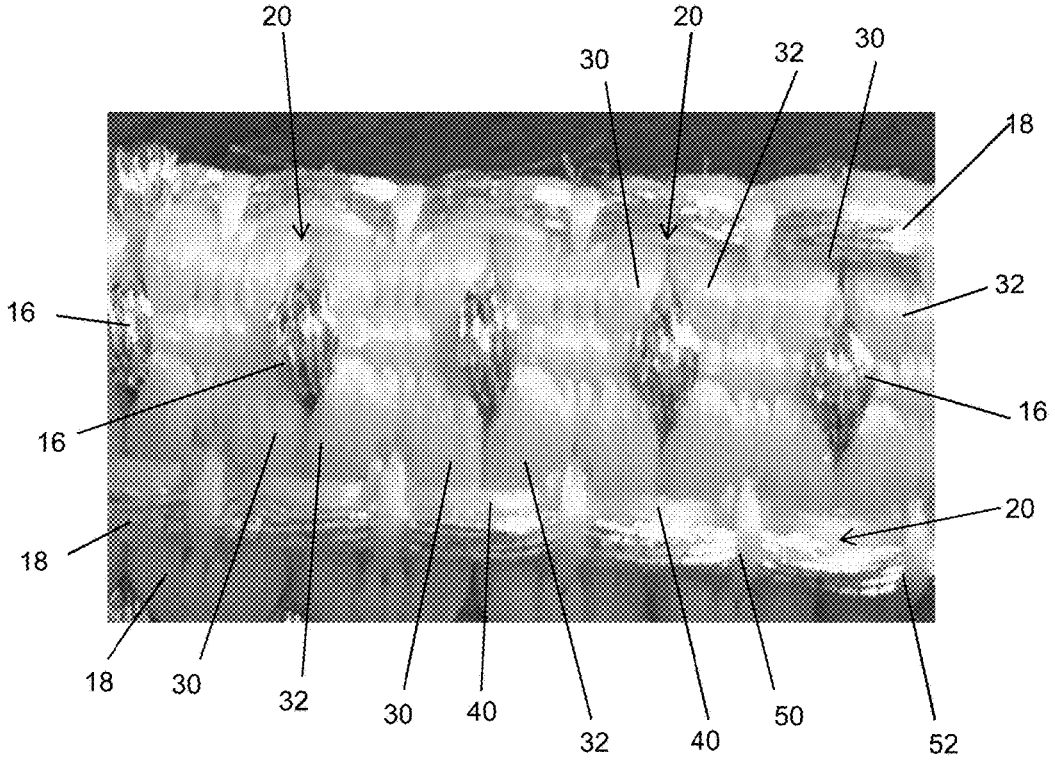
FIG. 3 is an enlarged view of the side of the fabric of FIG. 1, folded over and expanded to emphasise the weave structure.

FIGS. 1, 2 and 3 are photographs of a woven fabric according to the teachings herein. FIGS. 1 and 2 show the two sides of the fabric and could be described, for example, respectively as the upper side and underside of the fabric, though this is merely for ease of description. FIG. 3 is an enlarged view of the upper side of the fabric of FIG. 1, which has been folded transversely so as to show better the structure of the non-conductive separator elements within the weave.

With reference first to FIG. 1, this shows a portion 10 of a woven fabric in plan view, which is formed of a first set of fibres generally referred to by reference numeral 12 and a second set of fibres generally referred to by reference numeral 14. In this example, the first set of fibres 12 constitute the warp of the weave, whereas the second set of fibres 14 constitute the weft. It is to be understood that the warp and weft directions could be swapped and it is the relative structure of the yarns 12, 14 which is relevant not the orientation of manufacture. The sets of fibres 12, 14 are formed of a plurality of different types of yarns, as will become apparent below. The yarns are preferably in bundles.

The majority of the yarns forming the first and second sets of yarns 12, 14 are made of non-conductive material, for which any material known in the art may be suitable. These may be of natural material, such as cotton, wool and the like, but are preferably made of a synthetic material such as, for example, polyester, nylon, viscose or the like, or any combination of synthetic and natural materials.

The sets of yarns 12, 14 also include a plurality of conductors. In this embodiment there is provided a plurality of first conductors 16 in the first set of yarns 12 and a plurality of second conductors 18 in the second set of yarns 14. The conductors 16 in the first set, as well as the conductors 18 in the second set, are spaced from one another so that they do not come into physical contact with one another under normal usage of the fabric. As will be apparent from FIG. 1, the conductors 16 are disposed substantially parallel to and spaced from one another in the first direction 12, as are the second conductors 18.

The conductors 16 and 18, as well as the other yarns forming the fabric 10, are all woven into a single or common layer of fabric. In other words, the structure does not require two different woven structures, as seen for example in that woven structure known in the art as double cloth, or woven and non-woven layers interposed over one another. The conductors 16, 18 are therefore incorporated into the structure of the fabric 10 during the weaving process.

The conductors 16, 18 cross one another at a plurality of crossing points 20. At these crossing points 20, the first conductors 16 are located below a volume of non-conductive yarns hereinafter referred to as a non-conductive element 24. This volume of non-conductive yarns 24 physically separates the crossing conductors 16, 18 such that they do not, and in practice cannot, come into contact with one another and therefore they remain electrically separate from one another. The non-conductive element 24 is interposed directly between the crossing conductors 16 and 18, in what could be described as a linear arrangement of: conductor-non-conductive element-conductor.

In the example of FIG. 1 the fabric also includes a plurality of electrical connection points 22, in which crossing conductors 16, 18 are in physical contact with one another. These electrical connection points 22 form a permanent electrical connection between two crossing conductors 16, 18, with the intention that electrical signals or power can be transferred from one conductor 16 to the other conductor 18 and vice versa. This enables the structure to provide a complex conductive path through the fabric, for directing signals and/or power to different locations in the fabric and in practice to different locations in an article incorporating the fabric 10. The electrical connection points 22 are formed by not having a non-conductive element 24 interposed between the crossing conductors 16, 18.

The non-conductive element 24 is formed of one or more yarns of the first set of yarns 12, which extend generally parallel with the conductive yarns 16. As is described below in detail, the yarn or yarns of the non-conductive element 24 are in practice pressed, biased or moved so as to become disposed over the adjacent conductor 16 at a crossing point 20, achieved during weaving and by the weave structure. As a consequence, the non-conductive elements 24, which act as electrical insulators, are an integral part of the weave and do not require any additional components. The weave structure is also such as to ensure that the non-conductive yarns forming the element 24 retain this position over time and even when the fabric 10 is bent or folded.

FIG. 3 shows the fabric 10 in enlarged view compared to FIG. 1 and partially folded in the direction of the conductors 18, such that the structure of the fabric 10 and the crossing points 20 can better be seen. The non-conductive elements 24 are, in the preferred embodiment, each formed of two non-conductive yarns 30, 32 which typically lie either side of an associated conductor 16 and are pulled over the conductor 16 at the crossing point 20 and towards one another so as to create a volume of non-conductive material over the conductor 16, in order to isolate it from the overlying crossing conductor 18. This is achieved by means of yarns passing in the second direction 14.

Specifically, and as is described in further detail below, a crossing non-conductive yarn 40 of the second set of yarns 14 extends across the yarns 30, 32 at the crossing points 20 and is woven so as to pull the yarns 30, 32 together and over the conductor 16. In practice, during the weaving process the conductor 16 is moved out of the plane of the yarns 30, 32, for example by holding the conductor 16 on a separate heddle or by physically pushing it away as described in further detail below, enabling the yarns 30, 32 to be pulled over the conductor 16. The crossing yarn 40 is arranged to keep the yarns 30 and 32 precisely over conductive yarn 16 so as to create the insulating barrier between the yarns 16 and 18.

In the embodiment shown in FIGS. 1 to 3, the second conductors 18, extending in the in second direction 14, are woven so as to sit on top of the crossing yarn 40. This creates a second insulating barrier between the crossing conductors 16, 18 and a particularly robust structure which resists short circuiting even when the fabric 10 is folded, for example across the warp or across the weft.

As can be seen in FIGS. 1 and 3, the first set of yarns 12 also includes, for each conductor 18 across each crossing point 20 a pair of tie yarns 50, 52 which act to tie the conductor 18 over the crossing non-conductive yarn 40 of the second set of yarns 14 and to hold it in this position in the weave. The conductors 18 are therefore unable to move within the fabric structure, ensuring that a proper electrical separation is retained.

With reference now to FIG. 2, this shows the underside of fabric 10, that is the side opposite that visible in FIGS. 1 and 3. The conductive yarns 16 can be seen in FIG. 2, whereas the conductive yarns 18 are not visible as they sit above the underside surface of the fabric 10. The second set of yarns 14 include a series of non-conductive crossing yarns 60 which extend over the sections of conductive yarns 16 exposed in the bottom surface of the fabric 10. There are also provided sets of third and fourth tie yarns 62, 64 either side of each conductive yarn 16 and which pass over the crossing yarn 60, thereby to keep the conductive yarns 16 firmly in position also on this side of the fabric 10.

The non-conductive tie yarns 50, 52, 62, 64 could in some embodiments be separate yarns, whereas in other embodiments a common yarn could serve as two or more of the tie elements 50, 52, 62, 64.

Figure 4:
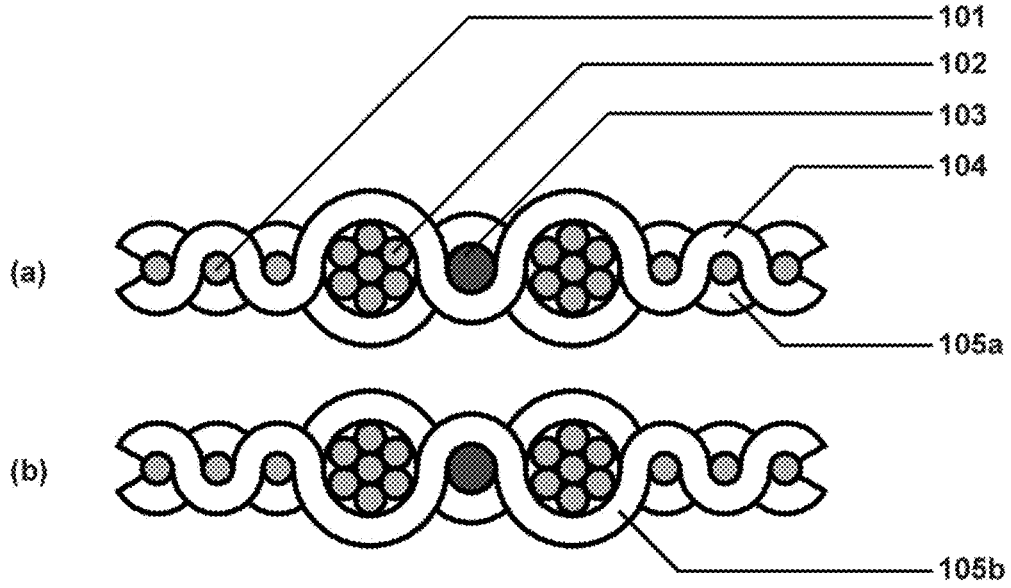
FIGS. 4 to 6 show warp transactional views of the embodiment of fabric of FIGS. 1 and 2 showing the weave structure of the preferred embodiment of conductive fabric.
Figure 5:
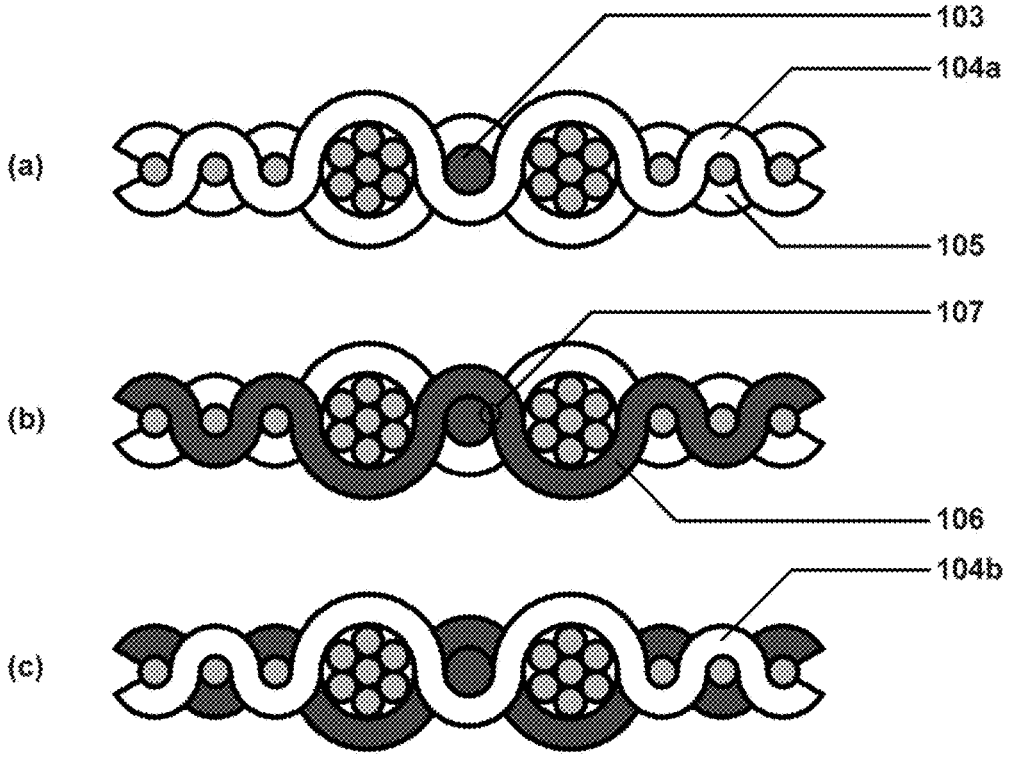
Figure 6:
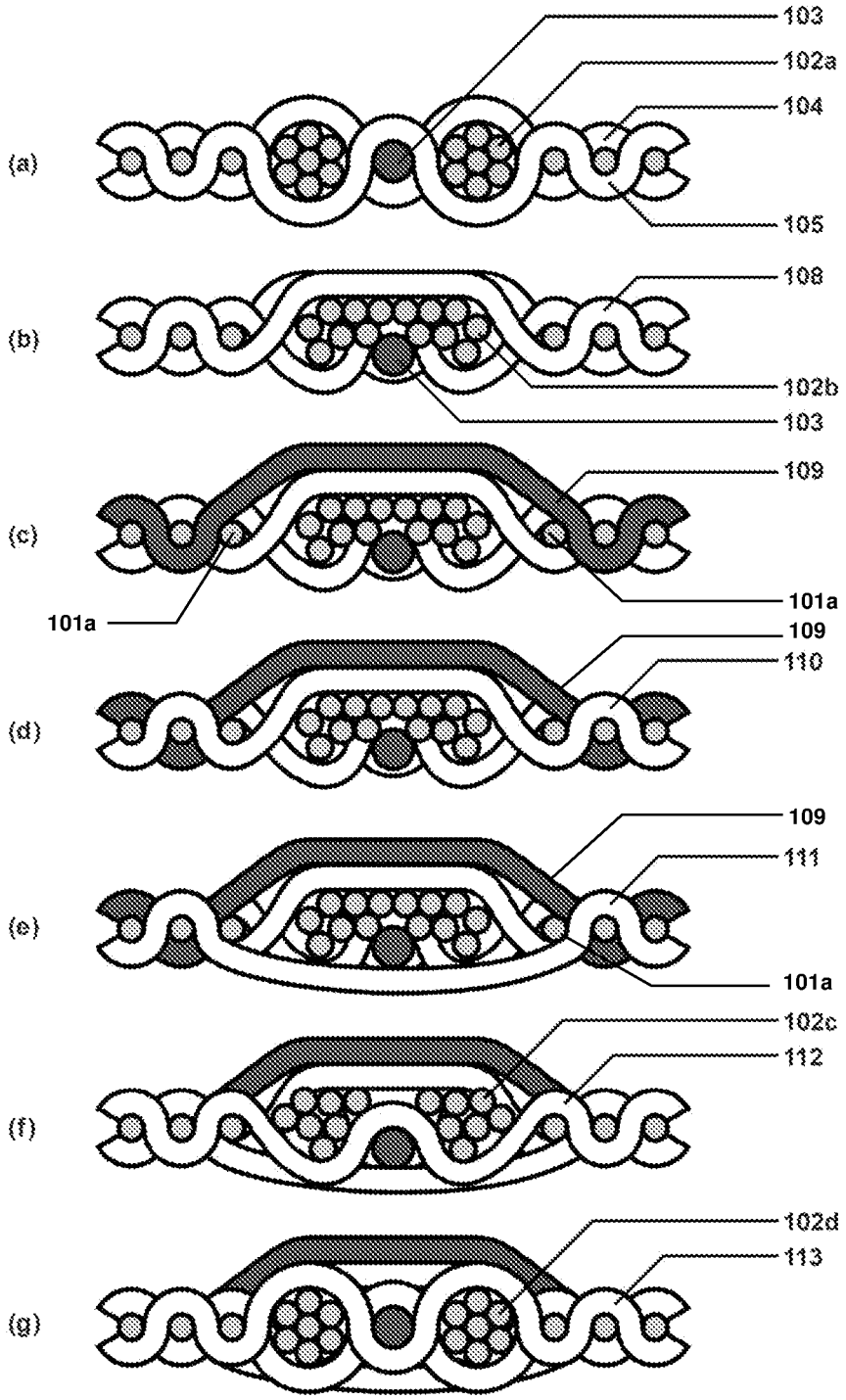

The structure of the preferred embodiment of fabric 10 can be more fully appreciated from a consideration of FIGS. 4 to 6, which show cross-sectional views of the fabric structure 10 of FIGS. 1 to 3 taken across the warp.

FIG. 4 shows a portion of the fabric 10 which is plain weave. FIG. 4(*a*) shows a cross-section at a first position in the fabric, whereas FIG. 4(*b*) shows a cross-section which is a single weft yarn further advanced. This sequence of Figures illustrates the manner in which the fabric 10 is constructed, one weft yarn at a time. This is analogous to the manner in which any woven fabric is constructed in practice.

With reference first to FIG. 4(*a*), there is plurality of non-conductive warp yarns 101 which extend in direction 12 of the fabric 10 and which conventionally lie side-by-side in a common plane. The yarns 101 may be multi-stranded yarns.

The yarns 12 also include a pair of non-conductive warp yarns 102, which are equivalent to the yarns 30, 32 inn FIGS. 1 to 3 and constitute, as will become apparent below, the non-conductive separator element 24 of the fabric 10. Each of the yarns 102 is treated during weaving as a single yarn. Indeed, the yarns 102 may each be constituted in some embodiments as a single yarn but are advantageously composed of a bundle of independent yarns or filaments. The bundle of yarns may or may not be twisted together. As will be apparent from FIGS. 4 to 6, it is preferred that the yarns 102 are formed from a greater number or strands or filaments than the yarns 101. In some embodiments, the number of strands or filaments in the yarns 102 may be a multiple of the number of strands or filaments in the yarns 101, numbering between two and ten times the number of yarns. The yarns 102 therefore have a greater volume than the yarns 101. This is not an essential characteristic of the yarns 102 as a fabric can be equally constructed with yarns 102 which are the same as the yarns 101 or even less voluminous than the yarns 101, but is the preferred form.

Also extending along the warp is a conductive yarn 103, which is equivalent to the yarns 16 shown in FIGS. 1 to 3.

A non-conductive weft yarn 104 interlaces with the warp yarns 101, 102, 103 can be seen in the Figure. Another non-conductive weft yarn 105*a*, which can be termed to be on an "alternate footing" to weft yarn 104, interlaces in a fashion that is laterally inverted to weft yarn 104.

FIG. 4(*b*) shows a further lateral cross-section of the fabric 10, in which the plane of cross-section has been advanced in the warp direction, by a distance of one weft yarn. Usefully, FIG. 4(*a*) could be viewed as a cross-section of a partially constructed fabric, and FIG. 4(*b*) as a similar cross-sectional view in which the subsequent non-conductive weft yarn, 105*b*, has been added.

It will be seen that the subsequent weft yarn 105*b* is in its own turn laterally inverted to weft yarn 104. Weft yarn 105*b* is therefore similar in interlaced geometry to weft yarn 105*a*.

Referring now to FIG. 5, this shows a portion of the fabric 10 in which a conductive weft yarn is introduced. In FIG. 5, the desired intent is that this conductive weft yarn makes permanent electrical contact with a conductive warp yarn. This produces the contact points 22 between the conductive yarns 16, 18 of FIGS. 1 and 3.

FIG. 5(*a*) shows a cross-section of the fabric 10 just prior to the insertion of the conductive weft yarn 106 (equivalent to the yarns 18 of FIGS. 1 and 3). It should be noted that this region of the fabric has a similar plain weave structure to that of FIG. 4.

A non-conductive weft yarn 104*a* extends in the weft direction, as is the non-conductive weft yarn 105 that precedes non-conductive weft yarn 104*a*, and is therefore interlaced on the alternate footing to 104*a*.

In FIG. 5(*b*) the next weft yarn has been inserted, which is a conductive weft yarn 106. It will be appreciated that the plain weave structure results in a large contact area 107 between the conductive warp yarn 103 and the conductive weft yarn 106.

FIG. 5(*c*) shows the subsequent weft yarn to be inserted, which is a non-conductive weft yarn 104*b* on a similar interlace footing to weft yarn 104*a*. The weft yarns 104*a* and 104*b* serve on either side to hold conductive weft yarn 106 in reliable electrical contact with conductive warp yarn 103.

FIG. 6 shows the sequence of weft yarn insertions that take place in order to construct a non-connected crossover point 20 between two conductive yarns 16, 18.

FIG. 6*a* shows the initial plain weave construction, similar to that of FIGS. 4 and 5, and which includes conductive warp yarn 103 (equivalent to the conductive yarns 16 of FIGS. 1 to 3), a bundle of non-conductive warp yarns 102*a*, and non-conductive weft yarns 104 and 105 on alternating interlace footing.

FIG. 6*b* shows the insertion of a subsequent non-conductive weft yarn 108. The weft yarn 108 is not inserted with a plain weave interlace but instead is "floated" over three effective warp yarns, that is the conductive warp yarn 103 and the two bundles of non-conductive warp yarns 102*a* (these bundles being each treated as single yarns for the purposes of the weaving process). The floated weft yarn 108 serves to compress the two bundles of warp yarns 102*a* together, into a single mass of yarns 102*b*. Additionally, as this compressive force is applied by floated weft yarn 108 onto the bundles of warp yarns 102*a*, the increased local tension on the prior weft yarn 105 tends to deflect the conductive warp yarn 103 away from the floated weft yarn 108. This is downwards in this illustrative example.

The resulting, and desired, geometry is one in which the bundles of warp yarns 102*a* coalesce into a single bundle 102*b*, which is additionally forced into a position directly between the conductive warp yarn 103 and the floated weft yarn 108.

It is possible and sometimes desirable to repeat the insertion of additional floated weft yarns 108 at this point during construction, using a similar interlace structure. Such additional floated weft yarns can serve to enhance the desired geometry, by increasing the compressive force upon the bundles 102*a* and increasing the tensile force on prior weft yarn 105 which in turn exerts a greater downwards force upon the conductive warp yarn 103.

FIG. 6(*c*) shows the insertion of a subsequent conductive weft yarn 109, which equivalent to one of the yarns 18 of FIGS. 1 to 3. Conductive weft yarn 109 is also floated over a number of warp yarns, in similar fashion to the preceding weft yarn 108. However, it is advantageous that the conductive weft yarn 109 is floated over a greater number of warp yarns than the preceding weft yarn 108. The arrangement could be said to use spacer yarns 101*a* between the floated yarn 108 and each conductive weft yarn 109. The floated section of the conductive yarn 109 is therefore made looser than the floated section of the preceding weft yarn 108, because it is placed under less tension and is more free to deflect. The longer, looser float of the conductive yarn 109 tends therefore to sit in a position that is higher from the plane of the fabric than the preceding float.

FIG. 6(*d*) shows the insertion of another non-conductive weft yarn 110, which has a similar interlace geometry to weft yarn 108, and a correspondingly shorter float to that of conductive weft yarn 109. The shorter, tighter floats of the non-conductive weft yarns 108 and 110 either side of the conductive yarn float tend to push beneath the conductive yarn float and lift it further away from the plane of the fabric.

It is a desirable outcome that the non-conductive floats 108 and 109 are brought together into contact beneath the conductive yarn float 109 and coalesce, in order to create an additional layer of physical barrier between the conductive warp yarn 103 and conductive weft yarn 109. This desirable outcome may be enhanced by increasing the length of float of the conductive weft yarn 109 relative to the length of float of the non-conductive weft yarns 108 and 110. However, if the conductive weft yarn floats are excessively long they can become too loose and risk being damaged or making inadvertent electrical contact with other portions of the conductive warp yarn or any adjacent conductive weft yarns. The difference should therefore be kept within reasonable limits, which the skilled person will be able to determine readily.

The preferred method also enhances this outcome, and most effectively, by a technique referred herein as "cramming", wherein the weaving loom inserts a greater number of weft yarns into a given length of fabric, thereby increasing the "pick-density" locally to the crossover point. This can be achieved in the preferred embodiment by programing a positive-drive weaving loom to increase the "pick-rate" in the region of a crossover point. On direct-(geared-)drive weaving looms cramming may be achieved by halting the take-up momentarily, and/or performing multiple beat operations with the loom's reed for each weft insertion.

The desirable outcome may further be enhanced by reducing the weft insertion tension of the conductive yarn 103 relative to the adjacent non-conductive weft yarns 108 and 110. This may be influenced by various means, directly and indirectly, such as selecting yarns for their relative elasticity, varying the timing of weft insertion, or varying the shed geometry, according to the type and model of weaving loom employed.

Another enhancement of some embodiments increases the number of floated non-conductive weft yarns 108 and 110. It should be borne in mind that increasing the number of floated weft yarns 108 and 110 also results in an increase in the length of float of the conductive warp yarn 103 which, if excessive, can cause the conductive warp yarn 103 to become too loose and risk damage or inadvertent short circuits with other portions of the conductive weft yarn or any adjacent conductive warp yarns. The risk of such short circuiting can be reduced or avoided by the insertion of a non-conductive weft yarn 111, shown in FIG. 6(*e*) (and equivalent to the non-conductive yarn 60 visible in FIG. 2). This weft yarn 111 serves to "pin" the float of the conductive warp yarn 103 into position and prevent it from becoming too loose. In some embodiments, if the pinning weft yarn 111 is excluded, there can be the risk of inadvertent short circuits due to movement of the float of the conductive warp yarn 103, which can occur particularly in fabrics with large diameter conductive warp yarns and/or where multiple conductive warp yarns are desired to be closely spaced together. The pinning weft yarn 111 is therefore an advantageous feature in enabling the creation of fabrics that are robustly capable of carrying high currents and/or which exhibit a high density of independent conductive paths, both within a smaller area of fabric.

FIG. 6(*f*) shows the insertion of the subsequent non-conductive weft yarn 112, which is interlaced according once more to plain weave. The interlace footing of weft yarn 112 is similar to that of weft yarn 105. In similar fashion to weft yarn 105, the local tension imparted by weft yarn 112 on the conductive warp yarn 103 tends to deflect the conductive warp yarn 103 away from the floated weft yarns 108, 109 and 110.

To be noted also is that with the reintroduction of a plain weave interlace for this weft yarn 112, the bundles of non-conductive warp yarns 102*c* are brought apart once more.

FIG. 6(*g*) shows the insertion of the subsequent non-conductive weft yarn 113. This weft yarn 113 is interlaced according to plain weave, on the alternate footing to the prior plain weave weft 112. It can be seen that the bundles of warp yarns 102*d* are fully separated at this point, and also that the conductive warp yarn 103 is returned to a median position within the plane of the fabric.

Continued weaving of the fabric may now commence, with the insertion of plain weave non-conductive weft yarns according to the interlace fashions of weft yarns 104 and 105 as appropriate.

The sequence of weft insertions shown throughout FIG. 6 is merely illustrative of one preferred embodiment. In practice, variations of float length, multiple instances of weft insertion, and variations of weft sequencing may all be employed in combination on weft insertions 105, 108, 109, 110, 111, 112 and 113. This variation is according to and dictated by factors such as diameter of yarns, permissible area of fabric, permissible thickness of fabric, distance between adjacent conductive warp and/or weft yarns.

Figure 7:
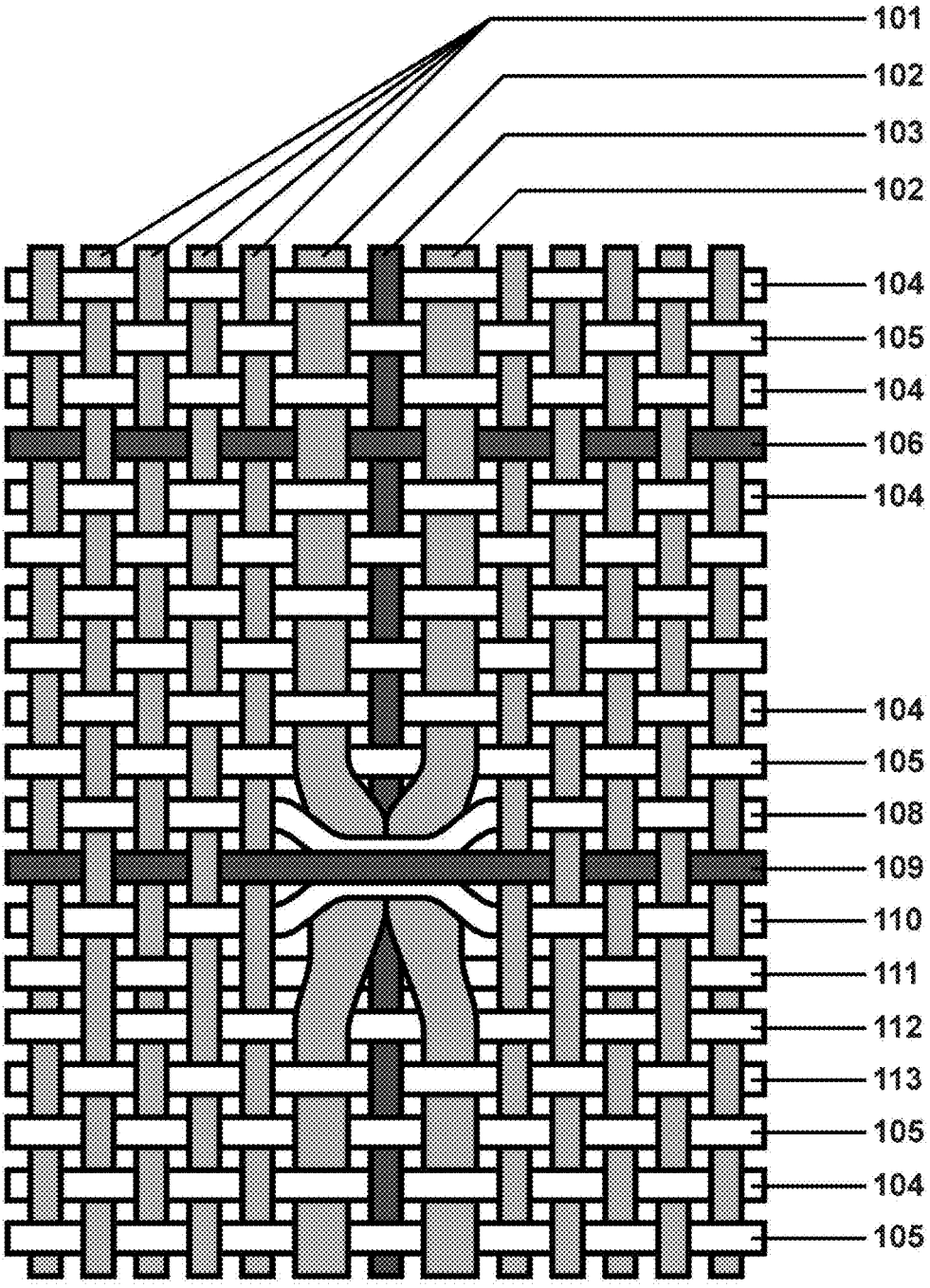
FIG. 7 is a schematic plan view of a fabric woven in accordance with the sequence of FIGS. 4 to 6 and the teachings herein.

FIG. 7 is a schematic plan view of a portion of fabric woven in accordance with the sequences shown in FIGS. 4 to 6 and as taught herein. In the portion a permanently separate crossing point 20 can be seen, as can a permanently connected crossing point 22. The bunching of the yarns 30,32 and of the cross-yarns 40 is also depicted. As can be seen, the at least two non-conductive yarns 30, 32 extending on opposing sides of the first conductor are laterally biased so as to be deflected over the first conductor at the crossing point 22.

Figure 8:
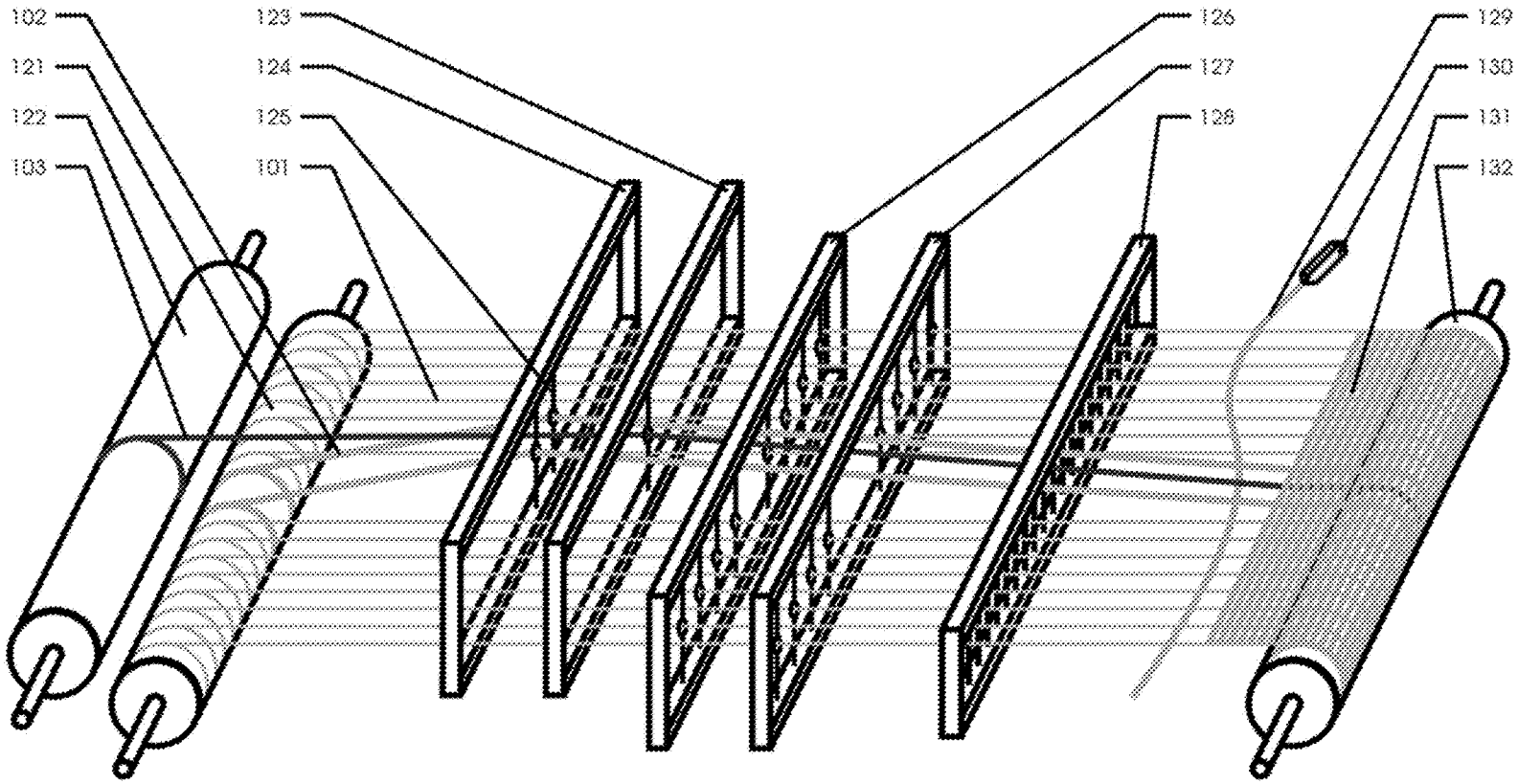
FIG. 8 is a schematic diagram of a weaving loom system for weaving conductive fabrics of the type disclosed herein.

Referring now to FIG. 8, this shows a representation of a preferred embodiment of weaving apparatus, configured in order to produce a fabric structure as taught herein. The weaving apparatus shown is a dobby loom, although a jacquard loom may also be employed. Note also that additional rollers for guiding the warp yarns, such as a breast beam, or whip or back beam, are not shown in the diagram, for clarity.

With reference to FIG. 8, 102 is the non-conductive warp yarn or bundle of non-conductive warp yarns that lies adjacent to the conductive warp yarn 103. Note that this warp yarn or yarns 102 is threaded through heddles 125, which are attached to a harness or shaft 124, which is independent from those of the remaining non-conductive warp yarns 101. A warp beam 121 carries the non-conductive warp yarns. Advantageously, but not essentially, this warp beam 121 is positively-driven by an independently controllable motor, such that the tension placed upon the non-conductive warp yarns may be monitored and controlled.

A warp beam 122 carries the conductive warp yarn 103. Advantageously, but not essentially, this warp beam 122 that is separate from the warp beam 121 that carries the non-conductive warp yarns 101 and 102. This advantageous feature of the weaving apparatus, proffered by the use of a twin-beam loom, aids the warping-up and subsequent weaving of conductive and non-conductive warp yarns that are substantially dissimilar in terms of diameter and elasticity.

Also advantageously, but not essentially, this warp beam 122 is positively-driven by an independently controllable motor, such that the tension placed upon the conductive warp yarns may be monitored and controlled, particularly in relative proportion to that tension placed upon the non-conductive warp yarns.

It is also possible for some or all of the warp yarns 101, 102 and 103, that warp beams are not employed, and that some or all of the warp yarns are instead fed into the weaving apparatus by means of bobbins, reels and/or creels, preferably with some mechanism for the tension control of the yarn as it is fed.

A conductive warp yarn 103 is shown, fitted on the warp beam 102. A harness, or shaft, 123 moves the heddles through which the conductive warp yarn is threaded. Note that this harness 123 is independent from the harnesses 124, 126 and 127 that carry the non-conductive warp yarns 101.

A harness, or shaft, 124 moves the heddles through which the non-conductive warp yarns, or bundles of non-conductive warp yarns, adjacent to the conductive warp yarn are threaded. Note that this harness 124 is independent from the harnesses 126 and 127 that carry the remainder of the non-conductive warp yarns, and from harness 123 that carries the conductive warp yarn 103.

A heddle 125, through which a single warp yarn is threaded, is raised or lowered by a particular harness or shaft. Note that multiple heddles may be used on a single shaft in the instance that multiple yarns or fibres or filaments are employed in concert to constitute a single warp yarn, such as in the cases that the non-conductive warp yarns 102 are bundles of yarns. Similarly, multiple heddles may be used on a single shaft in the case that multiple warp yarns are employed in concert to expand the width of the crossover structure and the length of the weft floats.

Reference numeral 101 depicts a non-conductive warp yarn that is not adjacent to a conductive warp yarn.

Harnesses, or shafts, 126 and 127 move the heddles through which the non-conductive warp yarns 101, that are not adjacent to the conductive warp yarn 103, are threaded. Shafts 126 and 127 are preferably each threaded with roughly half of the non-conductive warp yarns 101, in alternating fashion, such that these shafts, in concert with shafts 123 and 124, may form a plain weave. An alternative conventional weave structure, such as hopsack or twill, may be employed, in which instance these harnesses 126 and 127 may be threaded differently, accordingly.

A reed 128 is provided, which may advantageously be threaded, or sleyed, with multiple warp yarns in certain dents in order to increase the density of warp yarns in the vicinity of a conductive warp yarn.

A weft yarn 129 can be seen in the process of being inserted by means of a shuttle, which is only present where weaving is performed on a projectile loom. Weaving of the fabric may also be performed on a rapier loom or air-jet loom. Advantageously, a rapier loom is employed, for its superior ability in general to manipulate heavier and/or thicker weft yarns.

The woven fabric 131 can be seen at the end of the weaving process, being held by a cloth roller 132, otherwise known as a cloth beam or take-up beam. Advantageously, the cloth roller 132 is positively-driven or geared such that the speed of take-up of the finished fabric 131 may be controlled during the weaving process, preferably under the control of the same software program that sequences the lifting of the shafts. Consequently, the pick or weft density of the fabric 131 may advantageously be controlled and varied during weaving, for instance in order to increase the density of weft yarns in the vicinity of a crossover point.

The important features of the fabric and method of construction of the fabric include but are not limited to:

a) a non-conductive warp yarn, or yarns, or bundles of yarns, illustrated by 102, that are disposed to one or either side of a conductive warp yarn or yarns, the purpose of which non-conductive yarn(s) is to become forced into an interposed position between that conductive warp yarn(s) 103 and a crossing conductive weft yarn or yarns 109;

b) a non-conductive weft yarn or yarns, illustrated by 108 and 110, the purpose of which yarn(s) is to float over the conductive warp yarn(s) 103 and adjacent non-conductive warp yarns 102 in order to effect the forcing together and interposed positioning of the non-conductive warp yarns 102;

c) it is a further purpose of the non-conductive weft yarn(s), illustrated by 108 and 110, to become additionally interposed between a conductive warp yarn(s) 103 and a crossing conductive weft yarn(s) 109;

d) a non-conductive weft yarn or yarns, illustrated by 111, the purpose of which is to pin the floated portion of the conductive warp yarn(s) 103 into position, and avoid this float becoming too long and/or loose.

The embodiments described above make use of a pair of yarns or yarn bundles 30, 32, 102*a* to form the non-conductive element 24 of the fabric 10. However, in other embodiments, a single yarn or bundle of yarns may be used and trained to overlie the conductive yarn 16, 103. In other embodiments, more than two yarns or bundles or yarn may be used but this is not preferred.

The conductors of the fabric will typically be of low/negligible resistivity for data transfer and power supply purposes. Other embodiments may use one or more resistive conductive elements in a structure as that taught herein, for instance for heating purposes.

The fabrics disclosed herein can be used in a variety of different applications including for wearable apparel such as jackets, coats, vests, trousers, capes, as well as helmets, gloves and the like. The applications are not limited to wearable items, but also generally to all of those items where woven textile compositions are advantageous, and the addition of electrically conductive function therein might also be advantageous, such as in furnishings, carpeting, tenting, vehicle upholstery, luggage, hard composite structures, medical dressings, structural textiles and so on. The fabrics disclosed herein may also offer advantages over more conventionally constructed electrical circuits, such as printed circuit boards, flexible circuit boards, cable harnesses and wiring looms, due to the fabrics' flexibility, robustness, low-profile, light weight and automated means of manufacture.

All optional and preferred features and modifications of the described embodiments and dependent claims are usable in all aspects of the invention taught herein. Furthermore, the individual features of the dependent claims, as well as all optional and preferred features and modifications of the described embodiments are combinable and interchangeable with one another.

The disclosures in British patent application number 1522351.4 and in European patent application number 15275267.1, from which this application claims priority, and in the abstract accompanying this application are incorporated herein by reference.

What is claimed is:

1. A woven fabric including:

A. a first set of yarns extending in a first direction, the first set of yarns including:

I. a first electrical conductor, and

II. a non-conductive element defined by non-conductive yarns,

B. a second set of yarns extending in a second direction, the second set of yarns including a second electrical conductor, wherein:

a. the first and second sets of yarns are woven together, b. the first and second electrical conductors cross over one another at a crossing point, c. the non-conductive element is interposed directly between the first and second electrical conductors at the crossing point to provide a physical barrier between the first and second electrical conductors; and d. the non-conductive yarns of the non-conductive element:

(1) extend on opposing sides of the first conductor, and (2) are:

i. situated over the first conductor, and ii. laterally pressed, biased, or moved towards one another, at the crossing point, whereby a volume of non-conductive material is arranged over the first conductor at the crossing point so as to be interposed between the first and second conductors at the crossing point.

2. The woven fabric of claim 1 wherein the second set of yarns includes a non-conductive floating yarn extending over the non-conductive element at the crossing point.

3. The woven fabric of claim 2 wherein the non-conductive floating yarn of the second set is disposed below the second conductor at the crossing point, whereby the first and second conductors are disposed on opposing sides of:

a. the non-conductive element, and b. the non-conductive floating yarn of the second set, at the crossing point.

4. The woven fabric of claim 3 wherein the first set of yarns further includes first and second spacer non-conductive yarns disposed between the non-conductive floating yarn and the second conductor.

5. The woven fabric of claim 1 wherein the first set of yarns further includes first and second tie yarns:

a. extending over the second conductor, and b. holding the second conductor in position.

6. The woven fabric of claim 1 wherein the first and second conductors are conductive yarns.

7. The woven fabric of claim 6 wherein the non-conductive element has a greater number of strands or filaments than a number of strands or filaments of the first conductor.

8. The woven fabric of claim 1 wherein the non-conductive element has a greater width than a width of the first conductor.

9. The woven fabric of claim 1 wherein the non-conductive element is laterally expandable relative to the first conductor.

10. The woven fabric of claim 1 including a plurality of first and second conductors and a plurality of crossing points therebetween, at least one of the crossing points having non-conductive elements separating the crossing first and second conductors.

11. The woven fabric of claim 10 wherein at one or more of the crossing points, at least one pair of first and second conductors touch one another to make an electrical connection therebetween.

12. The woven fabric of claim 1 wherein:

a. the first set of non-conductive yarns and the first conductor extend along the warp of the fabric, and b. the second set of non-conductive yarns and the second conductor extend along the weft of the fabric.

13. The woven fabric of claim 1 wherein:

a. the first set of non-conductive yarns and the first conductor extend along the weft of the fabric, and b. the second set of non-conductive yarns and the second conductor extend along the warp of the fabric.

14. The woven fabric of claim 1 further including an item of apparel into which the woven fabric is incorporated.

15. The woven fabric of claim 14 wherein the item of apparel is a jacket, coat, vest, trousers, a cape, a helmet or gloves.

16. The woven fabric of claim 1 wherein:

a. the second set of yarns includes a non-conductive floating yarn:

(1) extending over the non-conductive element at the crossing point, and (2) being disposed below the second conductor at the crossing point, whereby the first and second conductors are disposed on opposing sides of:

i. the non-conductive element, and ii. the non-conductive floating yarn of the second set, at the crossing point;

b. the first set of yarns includes first and second spacer non-conductive yarns disposed between the non-conductive floating yarn and the second conductor;

c. the first set of yarns includes first and second tie yarns:

(1) extending over the second conductor, and (2) holding the second conductor in position.

17. A method of making a conductive woven fabric including the steps of:

a. providing for one of the warp and the weft a first set of yarns including:

(1) a first electrical conductor, and (2) a non-conductive element having non-conductive yarns, b. providing for the other of the warp and the weft a second set of yarns including a second electrical conductor;

c. weaving the first and second sets of yarns and conductors such that the first and second electrical conductors cross over one another at a crossing point;

d. weaving the non-conductive element so as to be interposed directly between the first and second electrical conductors at the crossing point to provide a physical barrier between the first and second electrical conductors;

e. disposing the non-conductive yarns on opposing sides of the first conductor; and f. laterally arranging the non-conductive yarns over the first conductor at the crossing point by:

(1) pulling the non-conductive yarns over the first conductor, and (2) laterally pressing, biasing, or moving the non-conductive yarns towards one another, at the crossing point, so as to create a volume of non-conductive material interposed between the first and second conductors at the crossing point.

18. The method of claim 17 including the step of pressing the non-conductive yarns together over the first conductor at the crossing point to provide a physical barrier between the first and second conductors.

19. The method of claim 17:

a. wherein the second set of yarns includes a non-conductive floating yarn, and b. further including the step of weaving the non-conductive floating yarn over the non-conductive yarn of the first set at the crossing point.

20. The method of claim 19 including the step of disposing the non-conductive floating yarn of the second set below the second conductor at the crossing point, whereby the first and second conductors are disposed on opposing sides of:

a. the non-conductive yarn of the first set, and b. the non-conductive floating yarn, at the crossing point.

21. The method of claim 20 including the steps of:

a. providing first and second spacer non-conductive yarns in the first set of yarns, and b. disposing the first and second spacer yarns between the non-conductive floating yarn and the second conductor.

22. The method of claim 17 including the steps of:

a. providing first and second tie yarns in the first set of yarns, and b. weaving the tie yarns so as to extend over the second conductor, whereby the second conductor is held in position.

23. The method of claim 17 wherein the first and second conductors are conductive yarns.

24. The method of claim 23 wherein the non-conductive yarn of the non-conductive element has a greater number of strands than a number of strands of the first conductor.

25. The method of claim 17 wherein the non-conductive element has a greater width than a width of the first conductor.

26. The method of claim 17 wherein the non-conductive element is laterally expandable relative to the first conductor.

27. The method of claim 17 including the steps of:

a. providing a plurality of first and second conductors, and b. weaving the first and second conductors so as to have a plurality of crossing points therebetween, at least one of the crossing points having non-conductive elements separating the crossing first and second conductors.

28. The method of claim 27 including weaving the yarns such that at one or more of the crossing points, at least one pair of first and second conductors touch one another to made an electrical connection therebetween.

29. The method of claim 17 wherein the first and/or second electrical conductors are subject to warp and/or weft floats over or under more than one yarn, whereby the non-conductive elements may be inserted.

30. The method of claim 17 wherein the fabric has a greater pick-density at the crossover points compared to a pick-density of the fabric away from the crossover points.

31. The method of claim 17 including the step of reducing weft insertion tension of the second conductor relative to adjacent non-conductive yarns of the second set.

* * * * *